US009647401B2

(12) United States Patent
Sato

(10) Patent No.: US 9,647,401 B2
(45) Date of Patent: May 9, 2017

(54) CONNECTOR DEVICE INCLUDING CABLE CONNECTOR

(71) Applicant: HIROSE ELECTRIC CO., LTD., Tokyo (JP)

(72) Inventor: Seitaro Sato, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/017,701

(22) Filed: Feb. 8, 2016

(65) Prior Publication Data

US 2016/0233611 A1 Aug. 11, 2016

(30) Foreign Application Priority Data

Feb. 10, 2015 (JP) ..... 2015-024410

(51) Int. Cl.
*H01R 13/58* (2006.01)
*H01R 24/00* (2011.01)
*H01R 13/627* (2006.01)

(52) U.S. Cl.
CPC ..... *H01R 24/005* (2013.01); *H01R 13/6273* (2013.01)

(58) Field of Classification Search
CPC H01R 23/682; H01R 13/193; H01R 13/6275; H01R 13/629; H01R 13/506; H01R 13/516; H01R 23/662; H01R 2103/00
USPC ..... 439/326, 342, 345, 376, 466, 468, 497, 439/578, 579
See application file for complete search history.

(56) References Cited

U.S. PATENT DOCUMENTS 4,820,179 A * 4/1989 Saijo ..... H01R 4/2466 439/224
6,398,581 B1 * 6/2002 Baier ..... H01R 12/616 439/404
6,837,737 B2 * 1/2005 Baier ..... H01R 12/616 439/402
6,910,904 B2 * 6/2005 Herrick ..... F04B 39/121 439/271
7,112,102 B2 * 9/2006 Masaki ..... H01R 12/75 439/660
7,303,444 B2 * 12/2007 Denpouya ..... H01R 13/629 439/660
7,354,313 B2 * 4/2008 Kumazawa ..... G02B 6/3897 439/638

(Continued)

*Primary Examiner* — Thanh Tam Le
(74) *Attorney, Agent, or Firm* — Rankin, Hill & Clark LLP

(57) ABSTRACT

A connector device includes first and second connectors including first and second housings. The second housing has a recess that receives the first housing. The first housing is connected to one end portion of a cable and has a first opening portion, which allows the other end portion of the cable to extend to the outside, on a peripheral wall at one side. An outer peripheral surface of the peripheral wall includes an inclined surface at the other side. The inclined surface is inclined so as to approach a bottom portion of the recess while extending in a direction from the one end portion toward the other end portion of the cable. The inclined surface is brought into contact with the recess so that the first connector is moved relative to the second connector in the direction from the one end portion toward the other end portion.

14 Claims, 8 Drawing Sheets

(56) References Cited

U.S. PATENT DOCUMENTS

| | | | | |
|---|---|---|---|---|
| 7,828,585 | B2 * | 11/2010 | Kurimoto | H01R 13/02 439/357 |
| 7,950,968 | B2 * | 5/2011 | Qian | H01R 9/03 439/466 |
| 8,011,944 | B2 * | 9/2011 | Umehara | H01R 13/58 439/345 |
| 8,043,114 | B2 * | 10/2011 | Kaneko | H01R 13/65802 439/468 |
| 9,048,569 | B2 * | 6/2015 | Chen | H01R 12/716 |
| 9,246,260 | B2 * | 1/2016 | Naganawa | H01R 13/516 |
| 9,287,643 | B2 * | 3/2016 | Yoshida | H01R 12/75 |
| 9,450,319 | B2 * | 9/2016 | Nishimura | H01R 12/75 |

* cited by examiner

CONNECTOR DEVICE INCLUDING CABLE CONNECTOR

BACKGROUND OF THE INVENTION

1. Field of the Invention

The present invention relates to, for example, an electrical connector device and an optical connector device including a pair of mutually engageable connectors, such as electrical connectors and optical connectors, and more particularly, to a connector device in which one of the connectors is a cable connector.

2. Description of the Related Art

Japanese Unexamined Patent Application Publication No. 2013-26159 describes, as a connector device of this type, an example of an electrical connector device. This connector device includes a first connector and a second connector that are mutually engageable. The first connector includes a first housing and a first terminal disposed in the first housing. The second connector includes a second housing having a recess that receives the first housing and a second terminal that is disposed in the second housing and electrically connectable to the first terminal.

The first housing is connected to one end portion of a cable and includes a first opening portion that is provided on a peripheral wall of the first housing at one side and enables the other end portion of the cable to extend to the outside of the first housing. Accordingly, the second housing includes a second opening portion that enables the other end portion of the cable to extend to the outside of the second housing.

Two actions are required to engage the first and second connectors of the connector device together. The first action is to insert the first connector into the recess in the second connector. The first action is performed by moving the first connector vertically relative to the recess. Next, as the second action, the first connector needs to be moved horizontally relative to the second connector so that the first connector is retained in the recess. In the second action, projections that project outward from an outer peripheral surface of the first connector slide under projections that project inward from an inner peripheral surface of the recess, so that the first and second connectors are locked.

In the above-described structure according to the related art, the two actions, which are the vertical movement and the horizontal movement, are required to lock the first and second connectors. Therefore, the engagement process is very cumbersome, and it is difficult to automate the process by using a robot.

SUMMARY OF THE INVENTION

The invention of this application has been made to solve the above-described problem of the related art, and an object of the present invention is to provide a connector device with which a vertical movement and a horizontal movement can be achieved simultaneously with a single action. It is also an object of the present invention to provide a connector device in which first and second connectors can be locked by the above-described movements.

A connector device according to an aspect of the present invention includes a first connector and a second connector that are mutually engageable, the first connector including a first housing and the second connector including a second housing having a recess that receives the first housing. The first housing is connected to one end portion of a cable and has a first opening portion on a peripheral wall of the first housing at one side, the first opening portion allowing the other end portion of the cable to extend to an outside of the first housing. The recess has a second opening portion on a peripheral wall of the recess at the one side, the second opening portion allowing the other end portion of the cable to extend to an outside of the second housing. At least a portion of an outer peripheral surface of the peripheral wall of the first housing at an opposing side that opposes the one side includes an inclined surface that is inclined so as to approach a bottom portion of the recess while extending in a direction from the one end portion toward the other end portion of the cable along an extending direction of the cable, the inclined surface being brought into contact with at least a portion of the recess so that, during an engagement process of engaging the first connector and the second connector together, the first connector is moved relative to the second connector in the direction from the one end portion toward the other end portion of the cable along the extending direction of the cable.

The present invention provides a connector device with which a vertical movement and a horizontal movement can be achieved simultaneously with a single action of pressing the first connector against the second connector.

In the connector device of the above-described aspect, at least a portion of the outer peripheral surface of the peripheral wall of the first housing at the one side may include another inclined surface that is inclined so as to approach the bottom portion of the recess while extending in the direction from the one end portion toward the other end portion of the cable along the extending direction of the cable, and at least a portion of an inner peripheral surface of the peripheral wall of the recess at the one side may include another inclined surface that corresponds to the other inclined surface of the first housing and that is inclined so as to approach the bottom portion of the recess while extending in the direction from the one end portion toward the other end portion of the cable along the extending direction of the cable. The other inclined surface of the recess may project in a direction from the other end portion toward the one end portion of the cable so that the other inclined surface of the recess and the other inclined surface of the first housing at least partially overlap in the extending direction of the cable when the engagement process of engaging the first connector and the second connector together is completed.

With this structure, even when, for example, the other end portion of the cable connected to the first connector is raised and the first connector is pulled in a direction away from the recess inadvertently, the inclined surface of the housing of the first connector and the inclined surface of the housing of the second connector come into contact with each other so that the first connector is effectively prevented from being pulled out.

In the connector device of the above-described aspect, at least a portion of a top surface of the first housing at the one side may project beyond a front end portion of the other inclined surface of the recess in the direction from the one end portion toward the other end portion of the cable when the engagement process of engaging the first connector and the second connector together is completed.

With this structure, the opening area of the recess can be reduced to address, for example, the problem of waste.

In the connector device of the above-described aspect, a projection that projects outward may be provided on an outer peripheral surface of the first housing at a side other than the one side and the opposing side, and a placement portion that corresponds to the projection may be provided on an inner peripheral surface of the recess at the side other than the one side and the opposing side, the placement portion projecting inward beyond the projection on the first housing when the first connector is placed on the second connector. The projection provided on the first housing may move over the placement portion provided on the recess so that the first connector and the second connector are locked.

With this structure, the first connector and the second connector can be locked by a single action of pressing the first connector against the second connector.

In the connector device of the above-described aspect, the outer peripheral surface of the first housing and the inner peripheral surface of the recess may have substantially rectangular shapes. The projection may be provided on the outer peripheral surface of the first housing at each of left and right sides that oppose each other in a region between the one side and the opposing side, and the placement portion may be provided on the inner peripheral surface of the recess at each of the left and right sides that oppose each other in the region between the one side and the opposing side.

In the connector device of the above-described aspect, one of the projections located near the one side of the first housing and one of the placement portions located near the one side of the second housing may form a pair, and one of the projections located near the opposing side of the first housing and one of the placement portions located near the opposing side of the second housing may form another pair. A force required for the one of the projections located near the one side of the first housing to move over the one of the placement portions located near the one side of the second housing is preferably greater than a force required for the one of the projections located near the opposing side of the first housing to move over the one of the placement portions located near the opposing side of the second housing.

With this structure, the force applied to the front side of the first connector can be efficiently distributed to the rear side, and the first connector can be pressed against the second connector in a stable position.

In the connector device of the above-described aspect, before the first connector is moved relative to the second connector in the direction from the one end portion toward the other end portion of the cable along the extending direction of the cable as a result of the contact between the inclined surface and at least the portion of the recess, the projection and the placement portion of the one pair preferably come into contact with each other and the projection and the placement portion of the other pair preferably come into contact with each other so that the first housing is held in a predetermined orientation relative to the recess.

With this structure, the user can position the first connector relative to the second connector in a stable state before placing the housing of the first connector in the recess in the second connector.

In the connector device of the above-described aspect, the connector device may be an electrical connector device, the first connector may include a first terminal that is provided in the first housing, and the second connector may include a second terminal that is provided in the second housing and electrically connectable to the first terminal.

In the connector device of the above-described aspect, preferably, the first terminal and the second terminal are not electrically connected to each other when the projections and the placement portions are in contact with each other so that the first housing is held in the predetermined orientation relative to the recess.

With this structure, noise signals due to an unstable contact are not generated.

In the connector device of the above-described aspect, a guide surface that guides the first housing toward the bottom portion of the recess is preferably provided at an open side of the recess.

Accordingly, the first housing can be smoothly guided toward the bottom portion of the recess.

In the connector device of the above-described aspect, the second connector may be a substrate mounted connector.

In the connector device of the above-described aspect, at least a portion of an inner peripheral surface of the peripheral wall of the recess at the opposing side that opposes the one side may include another inclined surface that is inclined so as to approach the bottom portion of the recess while extending in the direction from the one end portion toward the other end portion of the cable along the extending direction of the cable, the other inclined surface being brought into contact with at least a portion of the first housing so that, during the engagement process of engaging the first connector and the second connector together, the first connector is moved relative to the second connector in the direction from the one end portion toward the other end portion of the cable along the extending direction of the cable.

A connector device according to another aspect of the present invention includes a first connector and a second connector that are mutually engageable, the first connector including a first housing and the second connector including a second housing having a recess that receives the first housing. The first housing is connected to one end portion of a cable and has a first opening portion on a peripheral wall of the first housing at one side, the first opening portion allowing the other end portion of the cable to extend to an outside of the first housing. The recess has a second opening portion on a peripheral wall of the recess at the one side, the second opening portion allowing the other end portion of the cable to extend to an outside of the second housing. At least a portion of an inner peripheral surface of the peripheral wall of the recess at an opposing side that opposes the one side includes an inclined surface that is inclined so as to approach a bottom portion of the recess while extending in a direction from the one end portion toward the other end portion of the cable along an extending direction of the cable, the inclined surface being brought into contact with at least a portion of the first housing so that, during an engagement process of engaging the first connector and the second connector together, the first connector is moved relative to the second connector in the direction from the one end portion toward the other end portion of the cable along the extending direction of the cable.

A connector device according to another aspect of the present invention includes a first connector and a second connector that are mutually engageable, the first connector including a first housing and the second connector including a second housing having a recess that receives the first housing. The first housing is connected to one end portion of a cable and has a first opening portion on a peripheral wall of the first housing at one side, the first opening portion allowing the other end portion of the cable to extend to an outside of the first housing. The recess has a second opening portion on a peripheral wall of the recess at the one side, the second opening portion allowing the other end portion of the cable to extend to an outside of the second housing. During an engagement process of engaging the first connector and the second connector together, the first connector is moved relative to the second connector in a direction from the one end portion toward the other end portion of the cable along an extending direction of the cable while a state in which a top surface of the first housing and a bottom surface of the recess in the second housing are substantially parallel is maintained.

The present invention provides a connector device capable of realizing both a vertical movement and a horizontal movement with a single action. The present invention provides a connector device capable of locking the first connector and the second connector as a result of the action.

DESCRIPTION OF THE PREFERRED EMBODIMENTS

A connector device according to a preferred embodiment of the present invention will be described with reference to the accompanying drawings. Although an electrical connector device 10 will be described herein, the present invention is not intended to be limited to electrical connector devices.

Figure 1:
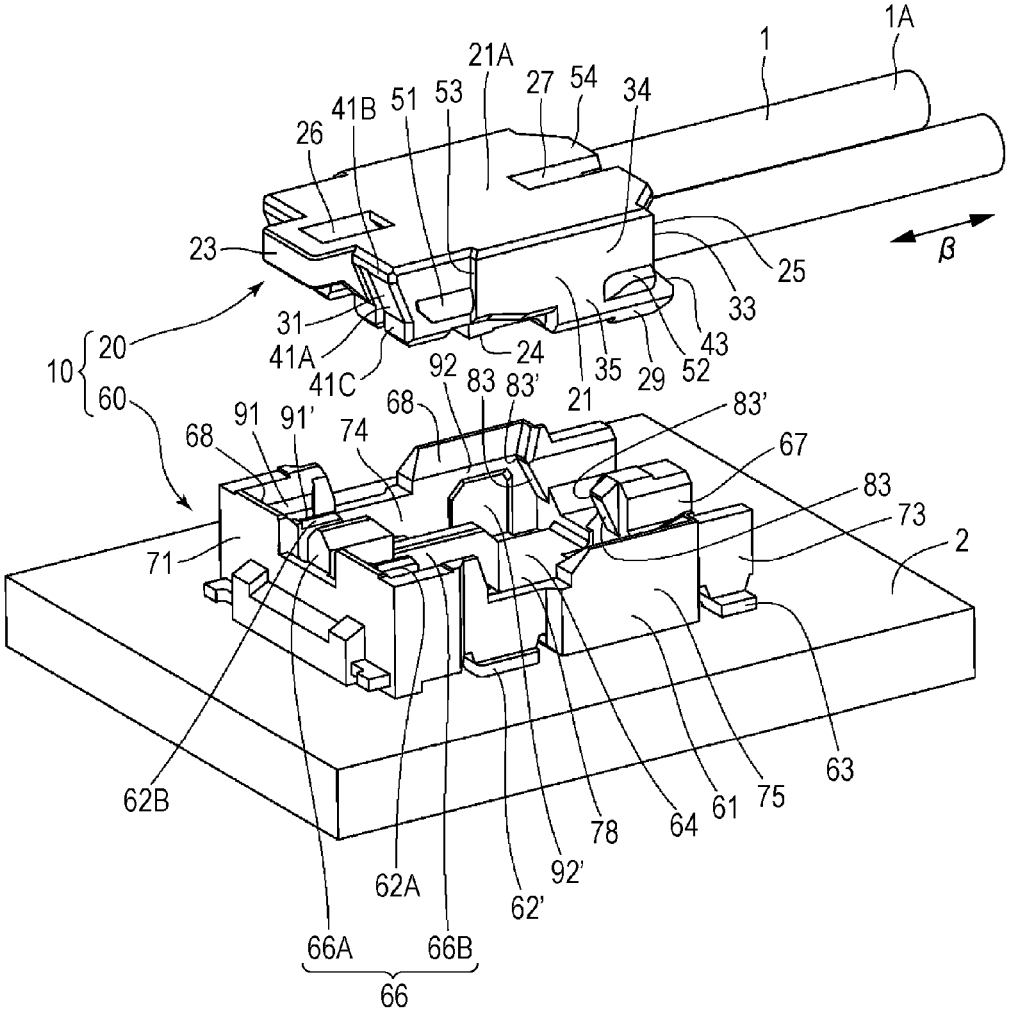
FIG. 1 is a perspective view of a connector device according to an embodiment of the present invention.
Figure 2:
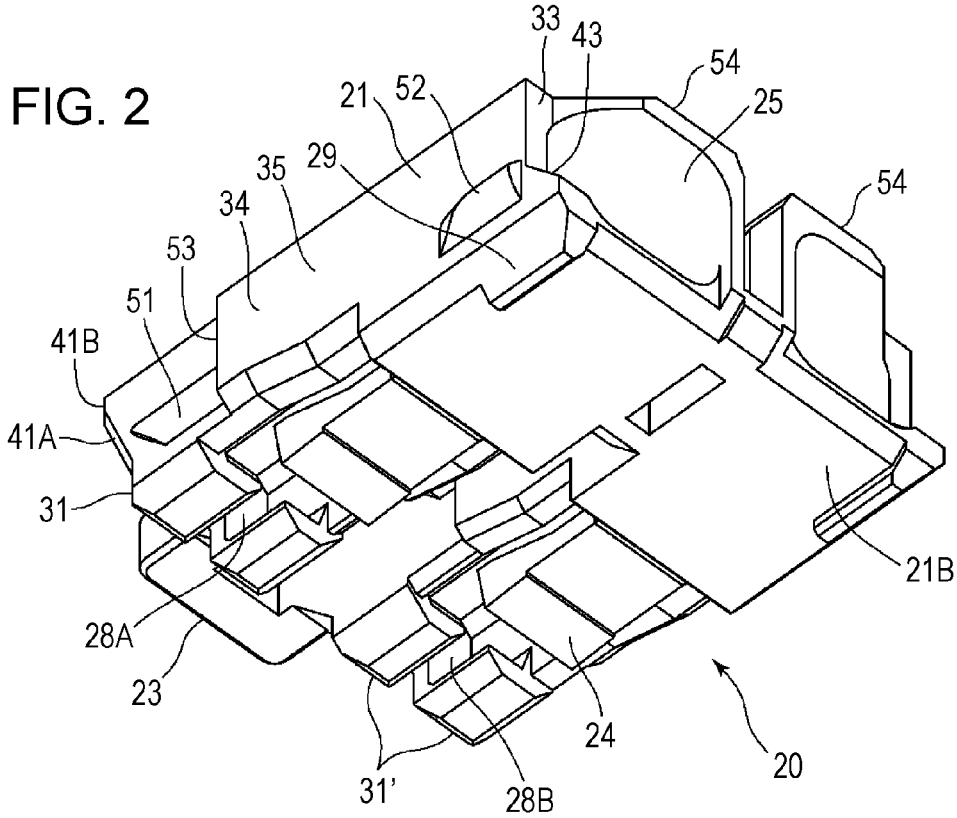
FIG. 2 is a bottom perspective view of a cable connector.

FIG. 1 is a perspective view of the electrical connector device 10, and FIG. 2 is a bottom perspective view of a cable connector 20. The electrical connector device 10 includes two connectors 20 and 60 that are mutually engageable. Each of the connectors 20 and 60 is vertically symmetrical. FIG. 1 illustrates the state in which the connectors 20 and 60 are not yet engaged and in which cables (electrical cables in this case) are attached to the connector 20. FIG. 2 illustrates only the connector 20 in the state in which the cables 1 are removed.

The connector 20 is a cable connector to which one end portions of cables 1 are connected. In the illustrated example, two cables 1 are connectable to the connector 20. However, the connector 20 may, of course, instead be configured such that one cable or three or more cables are connectable thereto. The connector 60 is a substrate connector mounted on a substrate 2. Although the substrate connector 60 is illustrated as an example, it is not necessary that the connector 60 be a substrate mounted connector. Similar to the connector 20, the connector 60 may instead be a cable connector.

The cable connector 20 includes a housing 21 and terminals 22 (illustrated in FIG. 8, which will be described below, and subsequent figures) disposed in the housing 21. The terminals 22 are electrically connected to the one end portions of the cables 1.

The substrate connector 60 includes a housing 61, terminals 62 disposed in the housing 61, and a reinforcing part 63. The terminals 62 include mounting portions 62' that are connected to predetermined wiring portions of the substrate 2. The housing 61 has a recess 64 that receives the housing 21 of the cable connector 20. When the housing 21 of the cable connector 20 is placed in the recess 64, the terminals 22 of the cable connector 20 are connected to the terminals 62 of the substrate connector 60. As a result of the connection between the terminals, the cables 1 are electrically connected to the wiring portions of the substrate 2. As long as the terminals 22 and the terminals 62 are electrically connected to each other, they are not required to be physically connected to each other.

The housing 21 of the cable connector 20 has a rectangular outer peripheral surface 34. Wall surfaces at a rear side 33, a front side 31 that opposes the rear side 33, and left and right sides 35 that oppose each other in a region between the front side 31 and the rear side 33 form a peripheral wall of the housing 21. Projections 51 and 52 that project outward are provided on the outer peripheral surface 34 of the housing 21 at each of the left and right sides 35, that is, the sides other than the front side 31 and the rear side 33. The projections 51 and 52 form a lock mechanism for the cable connector 20 and the substrate connector 60 together with portions (91 and 92) of the substrate connector 60. One projection 51 is disposed near the front side 31, and the other projection 52 is disposed near the rear side 33. The projection 51 near the front side 31 is a portion having a semicircular shape in cross section, and the projection 52 near the rear side 33 is a relatively large projection having a substantially triangular shape in cross section. The amount by which the projection 51 projects outward is smaller than the amount by which the projection 52 projects outward, and a step portion 53 is formed between the projections 51 and 52 so that the outer surface on which the projection 51 is formed is recessed from the outer surface on which the projection 52 is formed. Accordingly, the projection 51 is located on the inner side of the projection 52.

A raising portion 23 is provided in a front central region of a top surface 21A of the housing 21. The raising portion 23 projects toward the front side and may be used to disengage the cable connector 20 from the substrate connector 60. The cable connector 20 may be disengaged from the substrate connector 60 by raising the raising portion 23 upward so as to tilt the cable connector 20 upward and taking the cable connector 20 out of the recess 64 in the substrate connector 60.

A through hole 26 is formed in the top surface of the raising portion 23 in a central region of the top surface so as to extend through the raising portion 23 in the thickness direction of the cable connector 20. When the cable connector 20 and the substrate connector 60 are engaged, a portion (66A) of the substrate connector 60 is inserted into the through hole 26, so that the cable connector 20 and the substrate connector 60 are stably engaged. It is not necessary that the through hole 26 extend through the raising portion 23 as long as the portion (66A) of the substrate connector 60 can be inserted thereinto.

A hollow portion 27 is formed in the top surface 21A of the housing 21 so as to extend to the outer peripheral surface 34 of the housing 21 at the rear side 33. The hollow portion 27 is provided to enable a robot arm (not shown) to hold the cable connector 20, and is not essential.

The wall surface of the outer peripheral surface 34 of the housing 21 at the front side 31 includes three surfaces in each of the regions on the left and right sides of the raising portion 23. The three surfaces include an inclined surface 41A that is located substantially at the center and vertical surfaces 41B and 41C that sandwich the inclined surface 41A at the top and bottom of the inclined surface 41A. The vertical surface 41B is relatively small, and the vertical surface 41C is relatively large. The inclined surface 41A, which is located substantially at the center, is inclined so as to approach the bottom portion 78 of the recess 64 while extending in a direction from the one end portions toward the other end portions 1A of the cables 1 along an extending direction "β" in which the cables 1 extend (see FIG. 1). The inclined surface 41A serves an important function of moving the cable connector 20 relative to the substrate connector 60 in the direction from the one end portions toward the other end portions 1A of the cables 1 along the extending direction "β" of the cables 1 (see FIG. 1) during an engagement process of engaging the cable connector 20 and the substrate connector 60 together. It is not necessary that the vertical surfaces 41B and 41C be vertical, and may instead be inclined so that they serve as portions of the inclined surface 41A.

The peripheral wall of the housing 21 includes opening portions 25 at the rear side 33 in regions on the left and right sides of the hollow portion 27. The one end portions of the cables 1 are connected to the housing 21, and the other end portions 1A of the cables 1 extend to the outside of the housing 21 through the opening portions 25. In the present embodiment, two opening portions 25 are provided because two cables 1 are connectable to the housing 21. Inclined surfaces 43 are provided on the left and right sides of the opening portions 25. The inclined surfaces 43 are inclined so as to approach the bottom portion 78 of the recess 64 while extending in the direction from the one end portions toward the other end portions 1A of the cables 1 along the extending direction "β" of the cables 1 (see FIG. 1). The inclined surfaces 43 serve an important function of preventing the cable connector 20 from being pulled out when a rear end portion of the cable connector 20 is raised and pulled inadvertently.

Terminal-placement portions 28A and 28B, into which upright portions 62A and 62B of the terminals 62 of the substrate connector 60 are inserted, are provided on a bottom surface 21B of the housing 21. Lances 24 that engage with portions (84) of the substrate connector 60 are also provided on the bottom surface 21B. The edges of the bottom portion of the housing 21 preferably include tapered portions 29 so that the housing 21 can be smoothly inserted into the recess 64.

Figure 3:
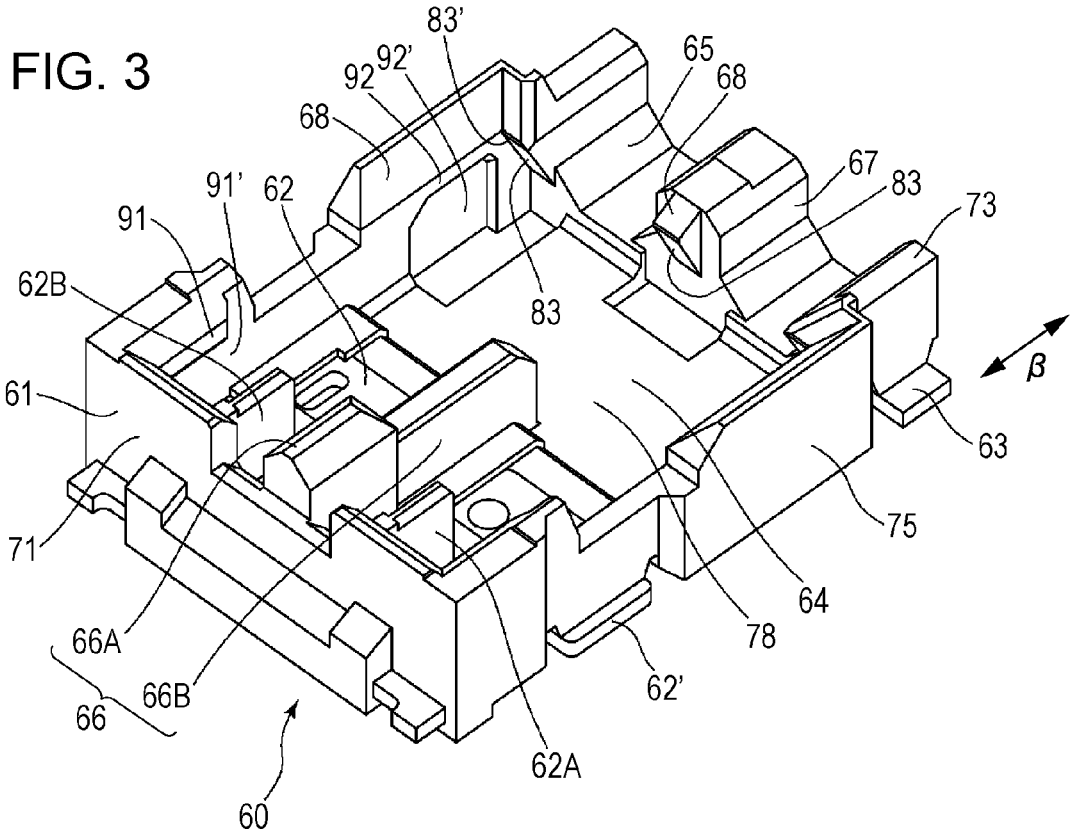
FIG. 3 is a top perspective view of a substrate connector.
Figure 4:
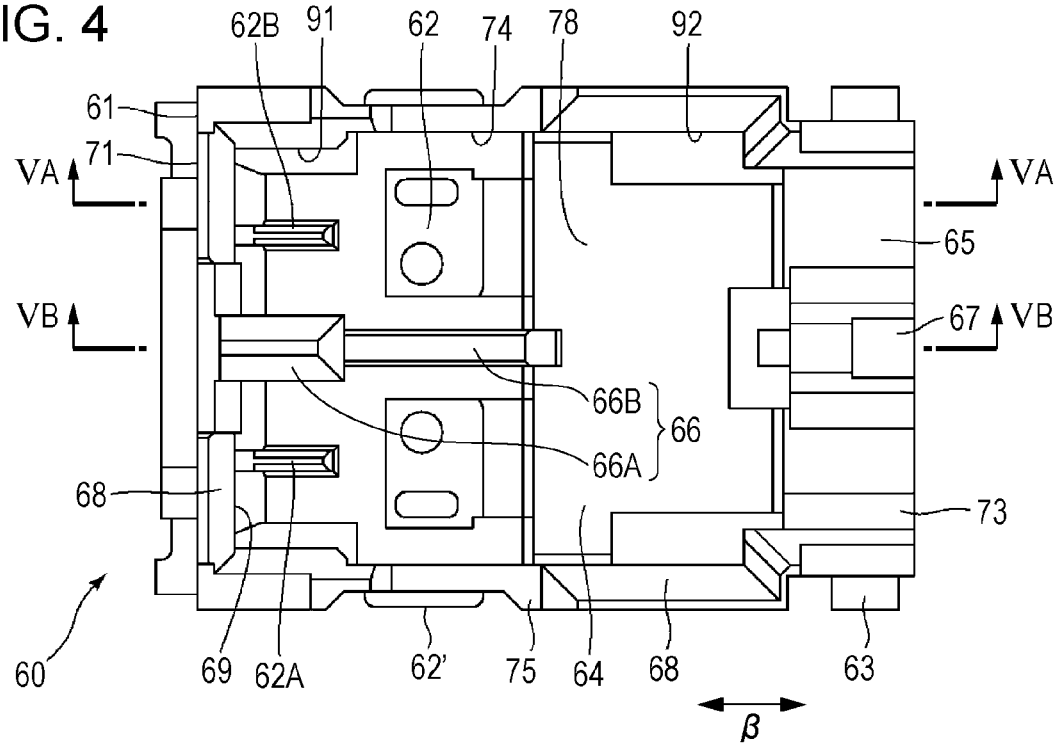
FIG. 4 is a plan view of the substrate connector.
Figure 5A:
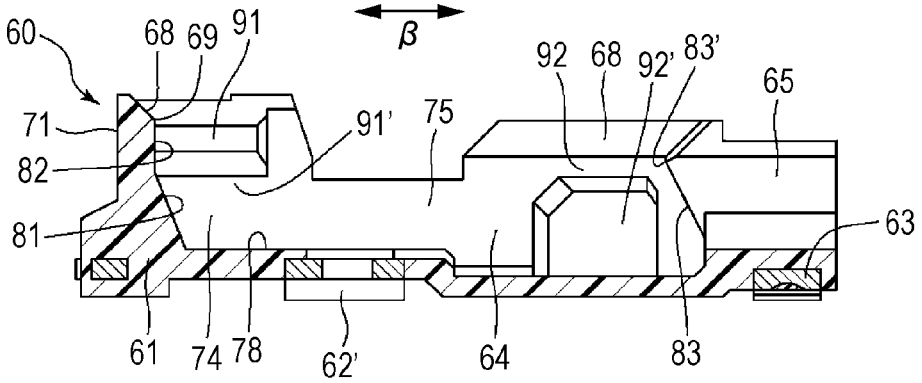
FIGS. 5A and 5B are sectional views of the substrate connector.
Figure 5B:
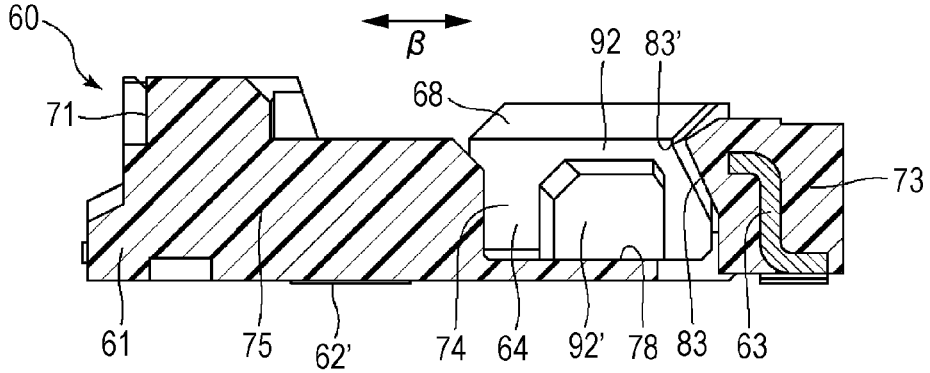

FIG. 3 is a top perspective view of the substrate connector 60. FIG. 4 is a plan view of the substrate connector 60. FIG. 5A is a sectional view taken along line VA-VA in FIG. 4, and FIG. 5B is a sectional view taken along line VB-VB in FIG. 4.

The recess 64 in the substrate connector 60 has an inner peripheral surface 74 having a rectangular shape so as to correspond to the outer peripheral surface 34 of the housing 21 of the cable connector 20. Wall surfaces at a rear side 73, a front side 71 that opposes the rear side 73, and left and right sides 75 that oppose each other in a region between the front side 71 and the rear side 73 form a peripheral wall of the recess 64. The recess 64 preferably has guide surfaces 68 at the open side thereof, the guide surfaces 68 guiding the housing 21 of the cable connector 20 toward the bottom portion 78 of the recess 64.

Placement portions 91 and 92 that correspond to the projections 51 and 52, respectively, of the cable connector 20 are provided on the inner peripheral surface 74 of the housing 61 at each of the left and right sides 75, that is, the sides other than the front side 71 and the rear side 73. The placement portion 91 projects inward beyond the projection 51 when the cable connector 20 is placed on the substrate connector 60. Similarly, the placement portion 92 has a hollow portion 92' so that the placement portion 92 projects inward beyond the projection 52 when the cable connector 20 is placed on the substrate connector 60. One placement portion 91 is disposed near the front side 71, and the other placement portion 92 is disposed near the rear side 73. The projection 52 provided on the housing 21 of the cable connector 20 and the placement portion 92 provided on the substrate connector 60 form a pair, and the projection 51 provided on the housing 21 of the cable connector 20 and the placement portion 91 provided on the substrate connector 60 form a pair. In the engagement process of engaging the cable connector 20 and the substrate connector 60 together, the projections 51 and 52 on the housing 21 of the cable connector 20 move over the placement portions 91 and 92 on the recess 64 in the substrate connector 60, so that the cable connector 20 and the substrate connector 60 are locked. Unlike the projections 51 and 52, the placement portions 91 and 92 project inward by substantially the same amount. However, the amount by which the projection 52 projects is greater than the amount by which the projection 51 projects in the cable connector 20. Therefore, the hollow portion 92', which is not provided at a location 91' where the projection 51 reaches after moving over the placement portion 91, is provided at a location 92' where the projection 52 reaches after moving over the placement portion 92, so that the projection 52 can be received. The above-described structure is preferably configured such that the force required for the projection 52 to move over the placement portion 92 is greater than the force required for the projection 51 to move over the placement portion 91. Accordingly, when the force required for the projection 52 to move over the placement portion 92 is applied to the cable connector 20 in the engagement process, not only does the projection 52 move over the placement portion 92 but also the projection 51 moves over the placement portion 91. Thus, the cable connector 20 can be pressed against the substrate connector 60 in a stable position. If the force required for the projection 52 to move over the placement portion 92 is smaller than the force required for the projection 51 to move over the placement portion 91, the projection 52 may move over the placement portion 92 while the projection 51 does not move over the placement portion 91. Accordingly, there is a risk that the front portion of the cable connector 20 will be raised from the recess 64 and the cable connector 20 cannot be pressed against the substrate connector 60 in a stable position. In the present invention, the forces are in the above-described relationship so that the cable connector 20 can be pressed against the substrate connector 60 in a stable position.

The substrate connector 60 includes two terminals 62 in total, the terminals 62 being arranged one on each of the left and right sides of the substrate connector 60. The two terminals 62 are formed integrally with the housing 61 together with the reinforcing part 63.

The terminals 62 include the upright portions 62A and 62B that stand on the bottom portion 78 of the recess 64 at the left and right sides of the housing 61 so as to extend toward the open side while portions thereof are retained by the inner peripheral surface 74 at the front side 71. In the engagement process of engaging the cable connector 20 and the substrate connector 60 together, the upright portions 62A and 62B are inserted into the terminal-placement portions 28A and 28B on the housing 21 of the cable connector 20. As a result, the upright portions 62A and 62B are connected to the terminals (22) of the cable connector 20.

A housing wall 66 that separates the upright portions 62A and 62B from each other is provided in a central section of the recess 64 the front side 71. The housing wall 66 may include two step portions 66A and 66B as illustrated in the figures. Since the housing wall 66 is provided between the terminals, the creepage distance between the terminals is increased.

The inner peripheral surface 74 of the recess 64, in particular, the wall surface at the front side 71, includes not only the guide surface 68 but also a vertical surface 82 and an inclined surface 81 arranged in that order toward the bottom portion 78 of the recess 64 in each of the regions on the left and right sides of the housing wall 66. Similar to the inclined surface 41A of the housing 21, the inclined surface 81 is also inclined so as to approach the bottom portion 78 of the recess 64 while extending in the direction from the one end portions toward the other end portions 1A (see FIG. 1) along the extending direction "β" of the cables (see FIG. 1). Since the inclined surface 81 is inclined in this manner, the inclined surface 81 is prevented from coming into contact with the inclined surface 41A of the housing 21. Similar to the inclined surface 41A of the housing 21, the inclined surface 81 may also be used to move the cable connector 20 relative to the substrate connector 60 in the direction from the one end portions toward the other end portions 1A of the cables 1 along the extending direction "β" of the cables 1 (see FIG. 1) during the engagement process of engaging the cable connector 20 and the substrate connector 60 together. This will be further described below.

Two opening portions 65, which are separated from each other by a separator 67 and correspond to the opening portions 25 provided on the housing 21 of the cable connector 20, are provided in the peripheral wall of the housing 61, in particular, in a portion of the peripheral wall at the rear side 73. The opening portions 65 communicate with the opening portions 25 of the housing 21 of the cable connector 20 that is accommodated in the recess 64, and are used to enable the other end portions 1A of the cables 1, to which the housing 21 is attached at the one end portions thereof, to extend to the outside of the housing 61.

The inner peripheral surface 74 of the recess 64, in particular, a portion of the inner peripheral surface 74 at the rear side 73, includes inclined surfaces 83 in regions where the opening portions 65 are provided. The inclined surfaces 83 are inclined so as to approach the bottom portion 78 of the recess 64 while extending in the direction from the one end portions (portions of the cables 1 to which the housing 21 is attached) toward the other end portions 1A (see FIG. 1) of the cables 1 along the extending direction "β" of the cables 1. The inclined surfaces 83 serve an important function of coming into contact with portions (43) of the cable connector 20 to prevent the cable connector 20 from being pulled out when the rear end portion of the cable connector 20 is raised and pulled inadvertently after the cable connector 20 and the substrate connector 60 have been engaged together.

The engagement process of the electrical connector device 10 will be described with reference to FIGS. 6 to 15.

Figure 6:
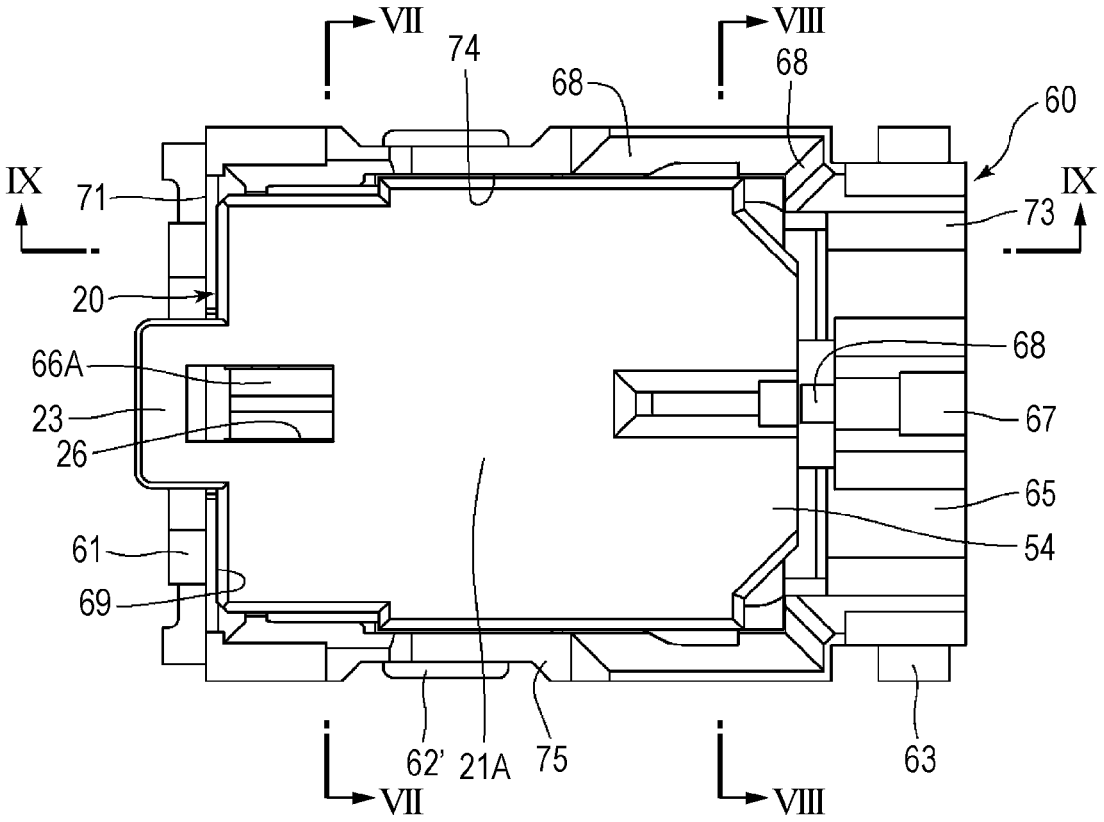
FIG. 6 is a plan view of the cable connector and the substrate connector before they are engaged together.
Figure 7:
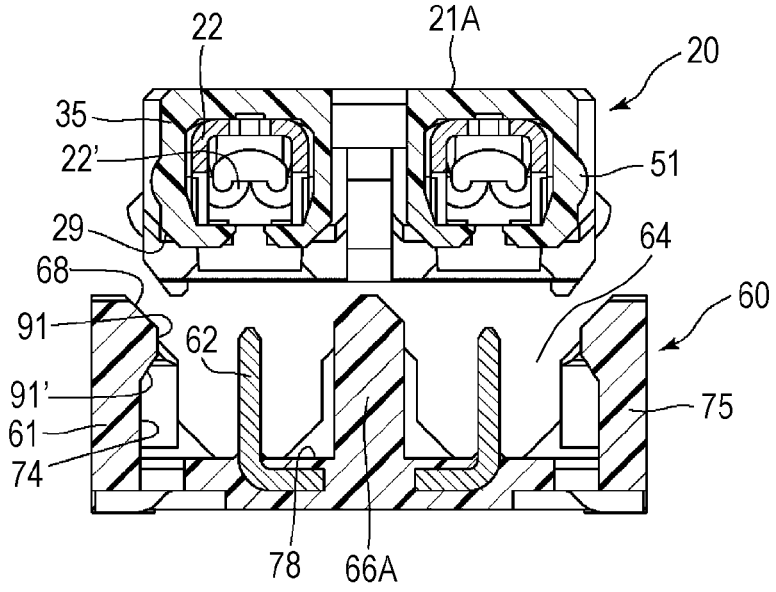
FIG. 7 is a sectional view taken along line VII-VII in FIG. 6.
Figure 8:
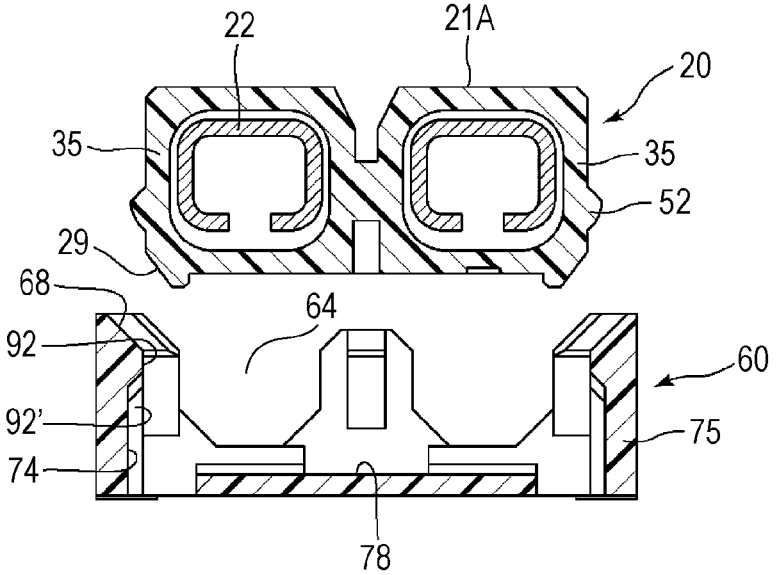
FIG. 8 is a sectional view taken along line VIII-VIII in FIG. 6.
Figure 9:
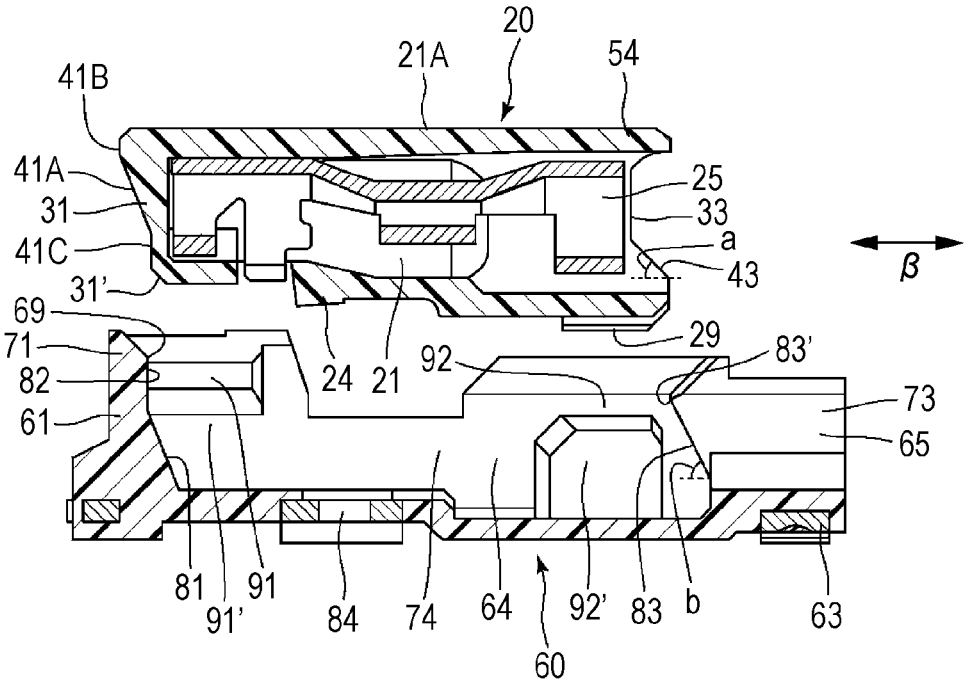
FIG. 9 is a sectional view taken along line IX-IX in FIG. 6.
Figure 10:
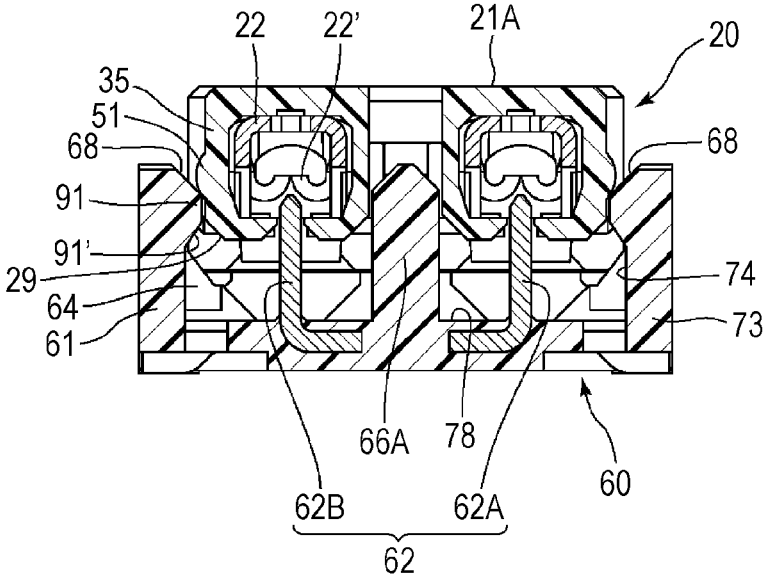
FIG. 10 is a sectional view illustrating an engagement process.
Figure 11:
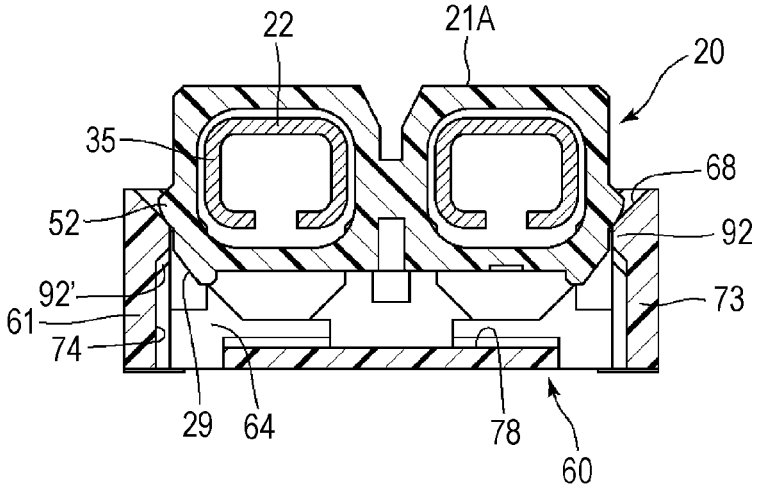
FIG. 11 is another sectional view illustrating the engagement process.
Figure 12:
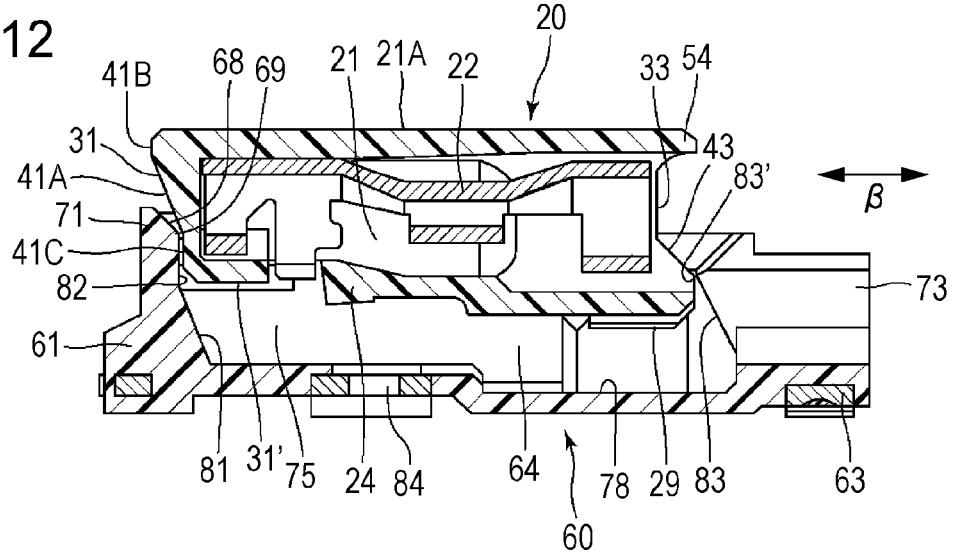
FIG. 12 is another sectional view illustrating the engagement process.

FIG. 6 is a plan view of the cable connector 20 and the substrate connector 60 before they are engaged together. FIG. 7 is a sectional view taken along line VII-VII in FIG. 6, FIG. 8 is a sectional view taken along line VIII-VIII in FIG. 6, and FIG. 9 is a sectional view taken along line IX-IX in FIG. 6. FIGS. 10 to 12 are diagrams illustrating the engagement process that correspond to FIGS. 7 to 9, respectively, and FIGS. 13 to 15 are diagrams illustrating the engaged state that correspond to FIGS. 7 to 9, respectively.

When the unengaged state illustrated in FIGS. 7 to 9 is changed to the engaged state illustrated in FIGS. 10 to 12, the cable connector 20 is guided to the recess 64 in the substrate connector 60 by the tapered portions 29 of the housing 21 and the guide surfaces 68 of the housing 61 of the substrate connector 60.

After that, the housing 21 of the cable connector 20 is further inserted into the recess 64 in the substrate connector 60 until the projections 51 provided on the housing 21 come into contact with the placement portions 91 provided on the housing 61 of the substrate connector 60 and the projections 52 provided on the housing 21 come into contact with the placement portions 92 provided on the housing 61 of the substrate connector 60. When the projections 51 and 52 are in contact with the placement portions 91 and 92, respectively, the housing 21 is in a predetermined orientation in the recess 64. At this time, each inclined surface 41A provided on the outer peripheral surface 34 at the front side 31 of the housing 21 of the cable connector 20 may or may not be in contact with the recess 64, in particular, an edge 69 of the recess 64 in the substrate connector 60. In the predetermined orientation, the cable connector 20 is positioned relative to the substrate connector 60 such that the top surface 21A of the housing 21 is substantially parallel to the bottom portion 78 of the recess 64 in the substrate connector 60. Thus, the user can position the cable connector 20 relative to the substrate connector 60 before placing the housing 21 of the cable connector 20 in the recess 64 in the substrate connector 60. When the cable connector 20 is in the predetermined orientation relative to the substrate connector 60 as described above, the terminals 22 of the cable connector 20 are not physically or electrically connected to the terminals 62 of the substrate connector 60. Therefore, noise signals due to an unstable contact are not generated.

Figure 13:
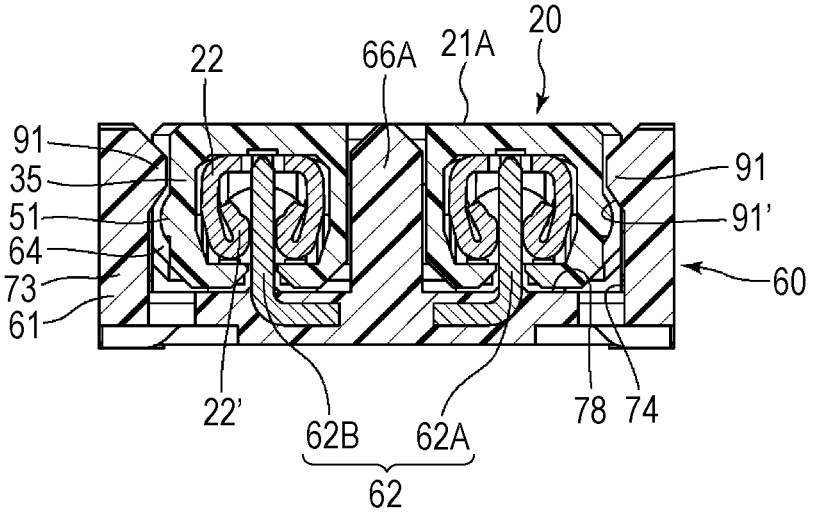
FIG. 13 is a sectional view illustrating the engaged state.
Figure 14:
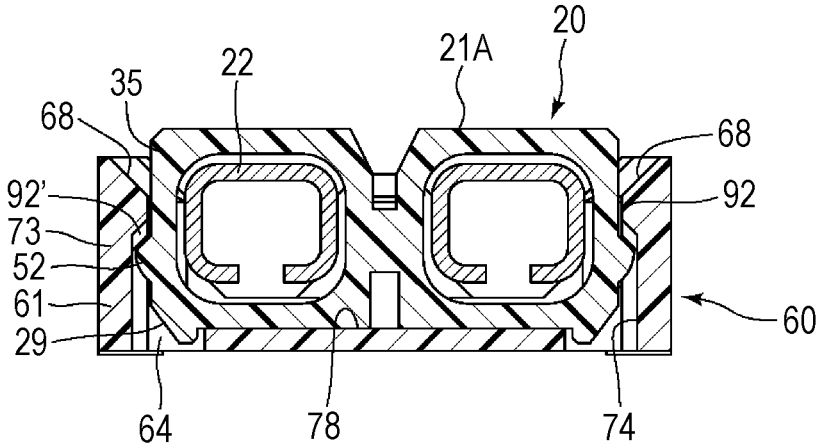
FIG. 14 is a sectional view illustrating the engaged state.
Figure 15:
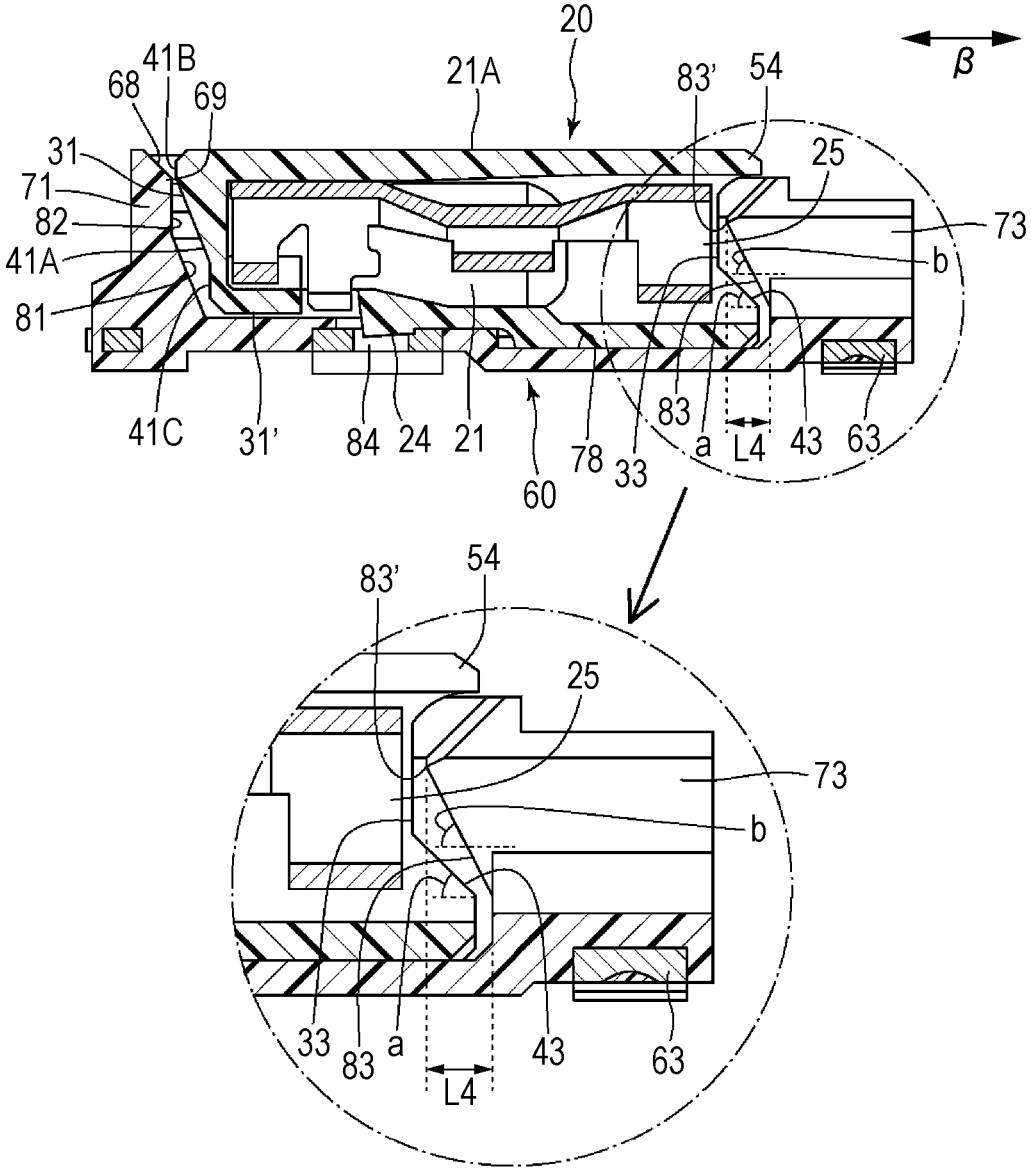
FIG. 15 is a sectional view illustrating the engaged state.

When the cable connector 20 is pressed against the substrate connector 60, the state in which the engagement process is being performed as illustrated in FIGS. 10 to 12 can be changed to the engaged state illustrated in FIGS. 13 to 15. At this time, each inclined surface 41A provided on the outer peripheral surface 34 at the front side 31 of the housing 21 of the cable connector 20 comes into contact with the recess 64 in the substrate connector 60, for example, with the edge 69 of the recess 64. As a result, the cable connector 20 moves relative to the substrate connector 60 in the direction from the one end portions toward the other end portions 1A of the cables 1 along the extending direction "β" of the cables 1 (see FIG. 1). More specifically, first, the inclined surface 41A comes into contact with the edge 69, and then the entirety of the cable connector 20 moves along the inclined surface 41A while the inclined surface 41A is continuously in contact with the edge 69. Thus, the cable connector 20 moves such that the inclined surface 41A serves as a reference surface and slides along the edge 69.

At this time, the projections 51 and 52 on the housing 21 of the cable connector 20 move over the placement portions 91 and 92 on the recess 64 in the substrate connector 60 at substantially the same time, so that the cable connector 20 and the substrate connector 60 are locked. Since the projections 51 and 52 move over the placement portions 91 and 92 at substantially the same time, the cable connector 20 can be moved relative to the substrate connector 60 while the orientation of the cable connector 20 relative to the substrate connector 60 is substantially maintained, in other words, while the top surface 21A of the housing 21 and the bottom portion 78 of the recess 64 in the substrate connector 60 are maintained substantially parallel to each other. The pressing force is also used to press the upright portions 62A and 62B of the terminals 62 into gaps in contact portions 22' of the terminals 22, so that the terminals 22 and the terminals 62 are electrically connected to each other.

After that, each inclined surface 43 provided on the outer peripheral surface 34 at the rear side 33 of the housing 21 of the cable connector 20 moves under the corresponding inclined surface 83 provided on the inner peripheral surface 74 at the rear side of the recess 64 in the substrate connector 60. As a result, as illustrated in FIG. 15, when the cable connector 20 and the substrate connector 60 are engaged together, the inclined surface 83 of the recess 64 and the inclined surface 43 of the housing 21 at least have an overlapping portion "L4" in which the inclined surfaces 83 and 43 overlap in the extending direction "β" of the cables 1. Since the overlapping portion "L4" is provided, even when, for example, rear portions of the cables 1 connected to the cable connector 20 are raised and the cable connector 20 is pulled in a direction away from the recess 64 inadvertently, the inclined surface 43 of the housing 21 of the cable connector 20 and the inclined surface 83 of the housing 61 of the substrate connector 60 come into contact with each other so that the cable connector 20 is effectively prevented from being pulled out. The inclination angle "a" (see FIGS. 15 and 9) of the inclined surface 43 relative to the substrate (see FIG. 1) or the bottom portion 78 of the recess 64 is smaller than the inclination angle "b" of the inclined surface 83 (see the enlarged view in FIG. 15 and FIG. 9). Accordingly, when the cables 1 are pulled upward, the lower portion of the inclined surface 43 comes into contact with the lower portion of the inclined surface 83, so that the cable connector 20 is reliably prevented from being pulled out.

When the cable connector 20 and the substrate connector 60 are engaged together, a rear portion 54 of the top surface 21A of the housing 21 projects beyond a front end portion 83' of the inclined surface 83 of the recess 64 in a direction from the one end portions toward the other end portions 1A of the cables 1. Accordingly, the rear portion 54 covers upper portions of the cables 1 over a large area. Thus, the opening area of the recess 64 can be reduced to address, for example, the problem of waste. In the engaged state, the lances 24 provided on the bottom surface 21B of the housing 21 are fitted to hollow portions 84 formed in the substrate connector 60 for the lances 24.

Although not illustrated, as a modification, similar to the inclined surfaces 41A provided on the housing 21 of the cable connector 20, the inclined surfaces 81 provided on the recess 64 may also be used to move the cable connector 20 relative to the substrate connector 60 in the direction from the one end portions toward the other end portions 1A of the cables 1 along the extending direction "β" of the cables 1 (see FIG. 1). In this case, the inclined surfaces 41A are not provided on the housing 21 of the cable connector 20, and vertical surfaces, for example, that extend along the vertical surfaces 41C are formed instead. When the inclined surfaces 41A are omitted, an edge 31' of the bottom portion of the housing 21 comes into contact with each inclined surface 81, so that the cable connector 20 is moved relative to the substrate connector 60 in the direction from the one end portions toward the other end portions 1A of the cables 1 along the extending direction "β" of the cables 1 (see FIG. 1). Obviously, the cable connector 20 may be moved by bringing each inclined surface 41A of the housing 21 into contact with the edge 69 of the recess 64, each inclined surface 81 of the recess 64 with the edge 31' of the bottom portion of the housing 21, or both the inclined surfaces 41A and 81 with the edges 69 and 31', respectively.

The present invention is not limited to the above-described embodiments, and various modifications are possible. For example, the structure of the connector device according to the present invention may be applied not only to an electrical connector device but also to an optical connector device. When the structure is applied to an optical connector device, optical fiber cables are connected instead of the electrical cables 1. Also, the outer peripheral surface 34 of the housing 21 of the cable connector 20 and the inner peripheral surface 74 of the recess 64 in the substrate connector 60 do not necessarily have a rectangular shape, and may instead have, for example, a circular shape or a square shape in plan view as long as one side and the other side that opposes the one side are provided. Various other modifications are also possible.

The present invention is applicable to various types of connector devices in which two types of movements, which are a vertical movement and a horizontal movement, are required to engage connectors together.

What is claimed is:

1. A connector device comprising:

a first connector and a second connector that are mutually engageable, the first connector including a first housing and the second connector including a second housing having a recess that receives the first housing, wherein the first housing is connected to one end portion of a cable and has a first opening portion on a peripheral wall of the first housing at one side, the first opening portion allowing the other end portion of the cable to extend to an outside of the first housing, wherein the recess has a second opening portion on a peripheral wall of the recess at the one side, the second opening portion allowing the other end portion of the cable to extend to an outside of the second housing, and wherein at least a portion of an outer peripheral surface of the peripheral wall of the first housing at an opposing side that opposes the one side includes an inclined surface and vertical surfaces that sandwich the inclined surface at a top and a bottom of the inclined surface respectively, the inclined surface being inclined so as to approach a bottom portion of the recess while extending in a direction from the one end portion toward the other end portion of the cable along an extending direction of the cable, the inclined surface being brought into contact with at least a portion of an inner peripheral surface of the peripheral wall of the recess at the opposing side so that, during an engagement process of engaging the first connector and the second connector together, the first connector is moved relative to the second connector in the direction from the one end portion toward the other end portion of the cable along the extending direction of the cable.

2. The connector device according to claim 1, wherein at least a portion of the outer peripheral surface of the peripheral wall of the first housing at the one side includes another inclined surface that is inclined so as to approach the bottom portion of the recess while extending in the direction from the one end portion toward the other end portion of the cable along the extending direction of the cable, wherein at least a portion of the inner peripheral surface of the peripheral wall of the recess at the one side includes another inclined surface that corresponds to the other inclined surface of the first housing and that is inclined so as to approach the bottom portion of the recess while extending in the direction from the one end portion toward the other end portion of the cable along the extending direction of the cable, and wherein the other inclined surface of the recess projects in a direction from the other end portion toward the one end portion of the cable so that the other inclined surface of the recess and the other inclined surface of the first housing at least partially overlap in the extending direction of the cable when the engagement process of engaging the first connector and the second connector together is completed.

3. The connector device according to claim 2, wherein at least a portion of a top surface of the first housing at the one side projects beyond a front end portion of the other inclined surface of the recess in the direction from the one end portion toward the other end portion of the cable when the engagement process of engaging the first connector and the second connector together is completed.

4. The connector device according to claim 1, wherein a projection that projects outward is provided on an outer peripheral surface of the first housing at a side other than the one side and the opposing side, wherein a placement portion that corresponds to the projection is provided on the inner peripheral surface of the recess at the side other than the one side and the opposing side, the placement portion projecting inward beyond the projection on the first housing when the first connector is placed on the second connector, and wherein the projection provided on the first housing moves over the placement portion provided on the recess so that the first connector and the second connector are locked.

5. The connector device according to claim 4, wherein the outer peripheral surface of the first housing and the inner peripheral surface of the recess have substantially rectangular shapes, wherein the projection is provided on the outer peripheral surface of the first housing at each of left and right sides that oppose each other in a region between the one side and the opposing side, and wherein the placement portion is provided on the inner peripheral surface of the recess at each of the left and right sides that oppose each other in the region between the one side and the opposing side.

6. The connector device according to claim 5, wherein one of the projections located near the one side of the first housing and one of the placement portions located near the one side of the second housing form a pair, wherein one of the projections located near the opposing side of the first housing and one of the placement portions located near the opposing side of the second housing form another pair, and wherein a force required for the one of the projections located near the one side of the first housing to move over the one of the placement portions located near the one side of the second housing is greater than a force required for the one of the projections located near the opposing side of the first housing to move over the one of the placement portions located near the opposing side of the second housing.

7. The connector device according to claim 4, wherein, before the first connector is moved relative to the second connector in the direction from the one end portion toward the other end portion of the cable along the extending direction of the cable as a result of the contact between the inclined surface and at least the portion of the inner peripheral surface of the peripheral wall of the recess, the projection and the placement portion of the one pair come into contact with each other and the projection and the placement portion of the other pair come into contact with each other so that the first housing is held in a predetermined orientation relative to the recess.

8. The connector device according to claim 7, wherein the connector device is an electrical connector device, the first connector includes a first terminal that is provided in the first housing, and the second connector includes a second terminal that is provided in the second housing and electrically connectable to the first terminal.

9. The connector device according to claim 8, wherein the first terminal and the second terminal are not electrically connected to each other when the projections and the placement portions are in contact with each other so that the first housing is held in the predetermined orientation relative to the recess.

10. The connector device according to claim 1, wherein a guide surface that guides the first housing toward the bottom portion of the recess is provided at an open side of the recess.

11. The connector device according to claim 1, wherein the second connector is a substrate mounted connector.

12. The connector device according to claim 1, wherein at least a portion of the inner peripheral surface of the peripheral wall of the recess at the opposing side that opposes the one side includes another inclined surface that is inclined so as to approach the bottom portion of the recess while extending in the direction from the one end portion toward the other end portion of the cable along the extending direction of the cable, the other inclined surface being brought into contact with at least a portion of the first housing so that, during the engagement process of engaging the first connector and the second connector together, the first connector is moved relative to the second connector in the direction from the one end portion toward the other end portion of the cable along the extending direction of the cable.

13. The connector device according to claim 1, wherein the first housing comprising a hole extending in a direction of a thickness of the first housing, wherein the second housing comprising a step portion extending in a direction of a thickness of the second housing, and wherein the step portion is inserted into the hole when the first connector and the second connector are engaged.

14. A connector device comprising:

a first connector and a second connector that are mutually engageable, the first connector including a first housing and the second connector including a second housing having a recess that receives the first housing, wherein the first housing is connected to one end portion of a cable and has a first opening portion on a peripheral wall of the first housing at one side, the first opening portion allowing the other end portion of the cable to extend to an outside of the first housing, wherein the recess has a second opening portion on a peripheral wall of the recess at the one side, the second opening portion allowing the other end portion of the cable to extend to an outside of the second housing, and wherein at least a portion of an inner peripheral surface of the peripheral wall of the recess at an opposing side that opposes the one side includes an inclined surface and a vertical surface positioned at a top of the inclined surface, the top opposing a bottom portion of the recess, the inclined surface being inclined so as to approach the bottom portion of the recess while extending in a direction from the one end portion toward the other end portion of the cable along an extending direction of the cable, the inclined surface being brought into contact with at least a portion of the first housing so that, during an engagement process of engaging the first connector and the second connector together, the first connector is moved relative to the second connector in the direction from the one end portion toward the other end portion of the cable along the extending direction of the cable.

* * * * *